US008474537B2

(12) United States Patent
Voss et al.

(10) Patent No.: US 8,474,537 B2
(45) Date of Patent: Jul. 2, 2013

(54) HIGH CAPACITY WELLHEAD CONNECTOR HAVING A SINGLE ANNULAR PISTON

(75) Inventors: Robert K. Voss, Peterculter (GB); Perry J. Stokes, Houston, TX (US); David W. Hughes, Hilltop Lakes, TX (US); Joseph W. Pallini, Jr., Tomball, TX (US); Robert N. Rogers, Tomball, TX (US); William T. Higgins, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 1082 days.

(21) Appl. No.: 12/170,043

(22) Filed: Jul. 9, 2008

(65) Prior Publication Data

US 2010/0006298 A1 Jan. 14, 2010

(51) Int. Cl.
*E21B 29/12* (2006.01)
*E21B 19/00* (2006.01)

(52) U.S. Cl.
USPC ..... 166/338; 166/368

(58) Field of Classification Search
None
See application file for complete search history.

(56) References Cited

U.S. PATENT DOCUMENTS 3,321,217 A * 5/1967 Ahlstone ..... 285/18
4,453,745 A 6/1984 Nelson
4,526,406 A * 7/1985 Nelson ..... 285/18
4,754,813 A * 7/1988 Jennings et al. ..... 166/344
4,856,594 A 8/1989 Jennings
4,902,044 A * 2/1990 Williams et al. ..... 285/18
5,433,274 A 7/1995 Graff et al.
6,129,149 A 10/2000 Beall
6,293,343 B1 * 9/2001 Pallini et al. ..... 166/345
2001/0045286 A1 11/2001 Pallini et al.
2005/0034870 A1 * 2/2005 Buckle et al. ..... 166/368

* cited by examiner

*Primary Examiner* — Thomas Beach
*Assistant Examiner* — James Sayre
(74) *Attorney, Agent, or Firm* — Bracewell & Giuliani LLP

(57) ABSTRACT

A wellhead connector for connecting a riser or production tree to a wellhead of a subsea well utilizes a singular annular piston to lock the connector onto the wellhead. The wellhead connector includes a housing that contains dogs for engagement with the exterior of the wellhead housing. A cam ring is also included, which has an inner side for engaging the dogs and moving them inward into a locked position with the wellhead housing. The cam ring is of a reduced proportion relative to prior art. As such, the cam ring outer side is dimensioned to contact the inner side of the connector housing under load. Connecting rods connect the piston to the cam rings. As the piston moves downward, the cam ring also moves downward, forcing the dogs inward into a locked position. As the piston moves upward, the cam ring also moves upward, thereby unlocking the connector. A secondary annular piston is also provided to guarantee unlocking.

At preload, a profile on the lower portion of the connector body engages a stepped profile on the outer diameter of the wellhead thereby creating a secondary load path for reacting to the applied bending moment.

17 Claims, 3 Drawing Sheets

HIGH CAPACITY WELLHEAD CONNECTOR HAVING A SINGLE ANNULAR PISTON

RELATED APPLICATIONS

This application is related to and claims priority and benefit of U.S. patent application Ser. No. 11/776,171, filed originally as a utility application and converted to a provisional application.

BACKGROUND

1. Field of the Invention

This invention relates in general to subsea wells, and in particular to a connector for connecting a riser to a subsea wellhead housing.

2. Description of the Prior Art

In a subsea well of the type concerned herein, a tubular wellhead is located on the sea floor. During drilling operations, a riser extends from a vessel at the surface down to the wellhead. A wellhead connector connects the lower end of the riser to the wellhead. After the riser is disconnected, a similar wellhead connector may be used to connect a subsea production tree to the wellhead. The wellhead connector has a housing which slides over the wellhead. In one type, a plurality of dogs are carried by the wellhead connector. The dogs include grooves on their interior sides. A cam ring moves the dogs inwardly into engaging contact with grooves formed on the exterior of the wellhead.

A plurality of pistons are spaced apart from each other circumferentially around the wellhead housing to move the cam ring axially between a locked and unlocked position. Because of the large cam ring cross-section and number of pistons, the connectors are large, heavy, and expensive to manufacture. Therefore, what is needed is a wellhead connector that is lighter, more efficient, and less expensive to manufacture.

SUMMARY OF THE INVENTION

The wellhead connector of the present invention utilizes a singular annular piston to lock the connector onto the wellhead. The connector includes a housing that contains a plurality of dogs having a set of grooves formed on their inner sides for engagement with a set of grooves on the exterior of the wellhead housing. A cam ring is also included, which has an inner side for engaging the dogs and moving them inward into a locked position with the wellhead housing. The cam ring is of a reduced proportion relative to prior art. As such, the cam ring outer side is dimensioned to contact the inner side of the connector housing under load. A plurality of connecting rods connect the annular piston to the annular cam ring. At preload, a profile on the lower portion of the connector body engages a stepped profile on the outer diameter of the wellhead thereby creating a secondary load path for reacting to the applied bending moment. As the piston moves downward, the cam ring also moves downward, forcing the dogs inward into the locked position. As the piston moves upward, the cam ring also moves upward, thereby unlocking the connector. A secondary annular piston is also included to guarantee unlocking.

DETAILED DESCRIPTION OF THE INVENTION

Figure 1:
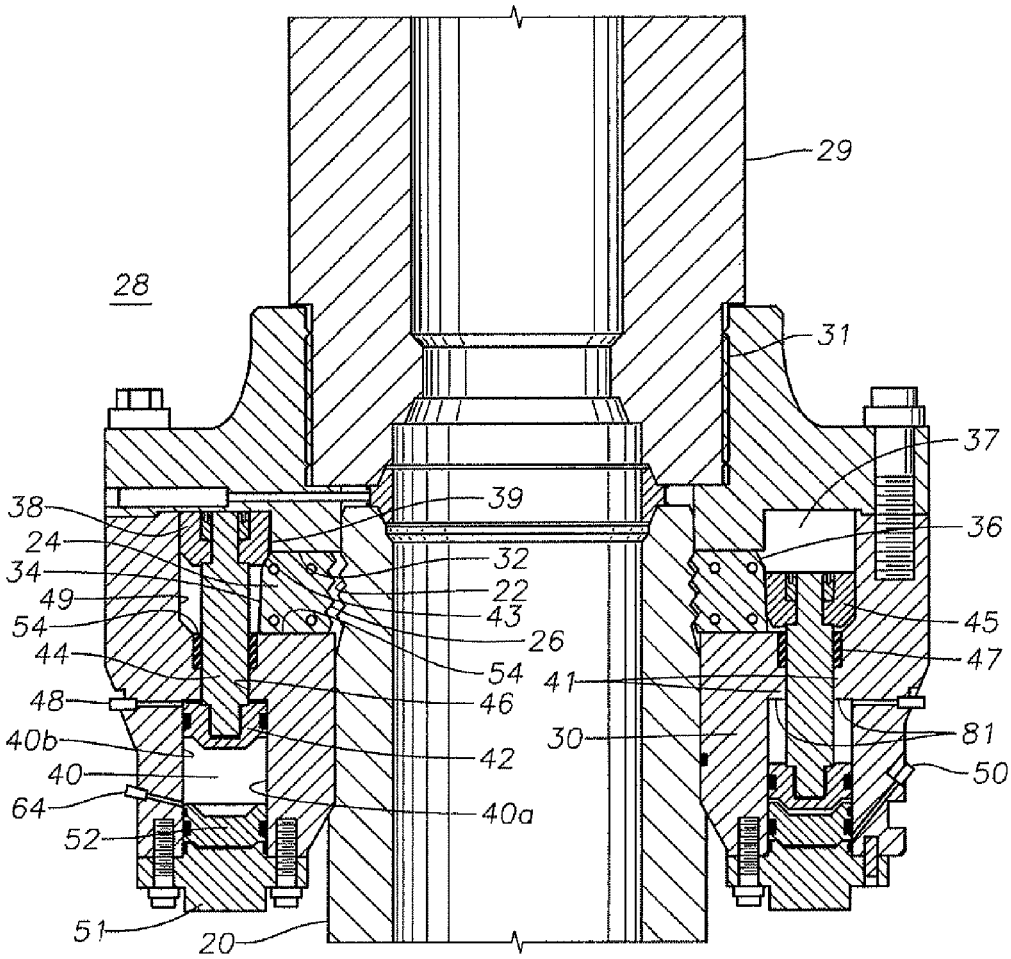
FIG. 1 is a partial sectional view illustrating a wellhead connector according to an embodiment of the present invention, with the left side shown unlocked and the right side shown locked.

Referring to FIG. 1, an exemplary embodiment is disclosed that illustrates a wellhead 20, which is a tubular member located vertically on the sea floor. A plurality of circumferential grooves 22 are formed on the exterior of wellhead 20 to provide a locking profile with a plurality of circumferential grooves 26 formed on the inside surfaces of dogs 24. Dogs 24 comprise part of a wellhead connector 28, which may be connected to a subsea production tree 29 by threads 31. Alternately, wellhead connector 28 could be secured to the lower end of a string of riser (not shown) which extends from a vessel at the surface.

The wellhead connector 28 includes a tubular housing 30. Housing 30 has an inner diameter that is slightly greater than the outer diameter of the wellhead 20. The housing 30 will slide over the wellhead 20 as the wellhead connector 28 is lowered into place. Dogs 24 are carried in aperture 32 spaced apart from each other around an inner circumference of wellhead connector 28. The dogs 24 will move between the retracted (i.e., unlocked) position shown on the left side in FIG. 1 to a locked position shown on the right side in FIG. 1.

Each dog 24 has an outer side 34 that is inclined. In this embodiment, the outer side 34 is a toriodal surface for optimized mechanical efficiency and load distribution. It inclines radially outward in a downward direction. A beveled edge 36 is located at the upper end of the outer side 34 of each dog 24. The inclination of each outer side 34 may be about three degrees relative to vertical.

A cam ring 38 is reciprocally carried by the housing 30 within an annular cam ring cavity 37. Aperture 32 is located between the cam ring cavity 37 and the inner wall of housing 30. The cam ring 38 is a solid annular member that moves vertically within annular cavity 37 in housing 30. Cam ring 38 has an inner side 39 that is inclined and which mates with the outer side 34 of dog 24. In this embodiment, the inner side 39 is a straight conical surface with a wider base at the bottom than that of the upper end. It inclines radially outward in a downward direction. A beveled edge 43 is located at the lower end of the inner side 39 of cam ring 38. The inclination of inner side 39 may be about three degrees relative to vertical. When cam ring 38 is in an upper position as shown on the left side of FIG. 1, cam ring outer diameter 45 has nominal running clearance with the outer diameter 49 of annular cavity 37. During connector lock on wellhead 20, cam ring outer diameter 45 contacts the outer diameter 49 of annular cavity 37 during downward travel of cam ring 38, connecting rods 44 and primary piston 42. Outer diameter 45 of cam ring 38 and outer diameter 49 of annular cavity 37 have a low coefficient of friction coating applied to significantly reduce hydraulic force required for connector 28 lock and unlock on wellhead 20.

A single, annular hydraulic chamber 40 is located in the wellhead connector housing 30 below cam ring cavity 37 and separated from cam ring cavity 37 by a bulkhead 41. Bulkhead 41 comprises downward facing surfaces 81 and upward facing surfaces 54 and is a solid annular disk shaped region of housing 30, except where penetrated by passages 46. Hydraulic chamber 40 extends around the circumference of wellhead 20 and has an axis coaxial with the axis of wellhead 20. Hydraulic chamber 40 has an inner cylindrical wall 40*a* and an outer cylindrical wall 40*b*. Inner and outer walls 40*a* and 40*b* are concentric relative to each other. A cap ring 51 is bolted to the bottom of connector housing 30 and is the bottom closure for hydraulic chamber 40.

The hydraulic chamber 40 contains an annular primary piston 42 that moves vertically within hydraulic chamber 40. Primary piston 42 has an inner diameter with a bidirectional seal 53 that slidingly engages hydraulic chamber inner wall 40*a*. Primary piston 42 has an outer diameter with a bidirectional seal 56 that slidingly engages hydraulic chamber outer wall 40*b*.

Figure 2:
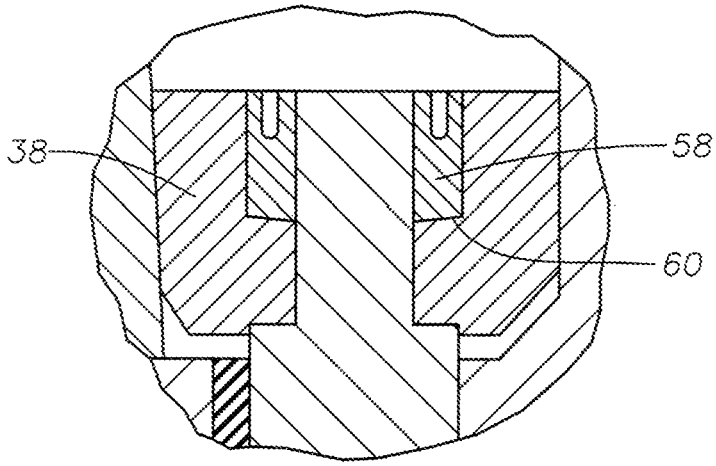
FIG. 2 is a partial sectional view illustrating an upper connecting rod and nut connection to the cam ring according to an embodiment of the present invention, with the cam ring bearing surface to nut bottom bearing surface shown.
Figure 3:
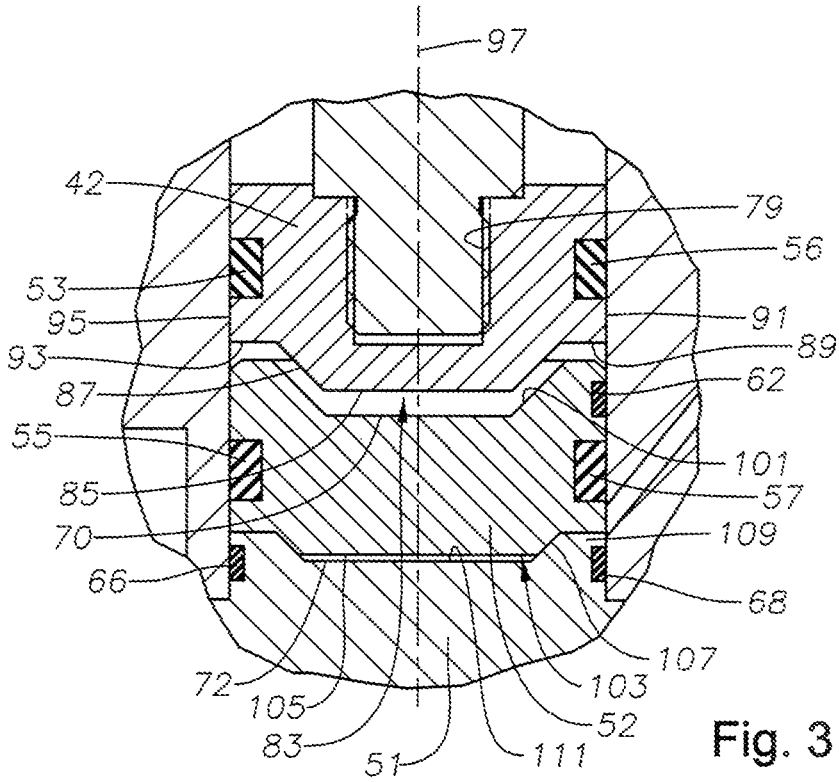
FIG. 3 is a partial sectional view illustrating the primary piston, secondary piston and cap ring in the connector lock position according to an embodiment of the present invention, with secondary piston and cap ring hydraulic conduits shown.

Primary piston 42 is connected to a plurality of connecting rods 44 (only two shown). Each connecting rod 44 extends through a passage 46 extending through bulkhead 41 of the housing 30 and further connects up to the cam ring 38. A bidirectional seal 47 in each passage 46 seals around one of the connecting rods 44 to seal the pressure in hydraulic chamber 40 from cam cavity 37. Each connecting rod 44 is cylindrical and has an outer diameter less than the distance between the inner and outer walls 40*a*, 40*b* of hydraulic chamber 40. Referring to FIG. 2 and FIG. 3, the ends of connecting rods 44 are threaded for securing into nuts 58 in cam ring 38 and threaded holes 79 in primary piston 42. The bottom surface of nut 58 and cam ring bearing surface 60 are spherical to allow connecting rods 44 to angularly deflect under load conditions. Bottom surface of nut 58 and cam ring bearing surface 60 have low coefficient of friction coatings applied to facilitate relative angular deflection of connecting rods 44 and nuts 58 to cam ring 38 under load conditions. Connecting rods 44 cause cam ring 38 to move up and down relative to dogs 24 in unison with primary piston 42, as can be seen by comparing the left and right sides of FIG. I. In an exemplary embodiment, primary piston 42 is connected to cam ring 38 via twelve connecting rods 44, however, other numbers of connecting rods can be used.

Referring to FIG. 3, primary piston 42 has a lower side with an annular band 83 extending downward and concentric with a longitudinal axis of housing 30 (FIG. 1). Annular band 83 has a bottom surface 85 that is flat and located in a plane perpendiclar to the longitudinal axis of housing 30. Annular band 83 has inner and outer side walls 87 that are inclined and converge toward each other in a downward direction. The inner side wall 87 joins band bottom surface 85 with an annular inner border surface 89, which extends inward to an inner side 91 of primary piston 42. The outer side wall 87 joins band bottom surface 85 with an an outer border surface 93, which extends outward to an outer side 95 of primary piston 42. Border surfaces 89, 93 are flat and located in a single plane parallel to and elevated above band bottom surface 85. When viewed in a transverse cross-section, as in FIG. 3, annular band 83, side walls 87, and border surfaces 89, 93 are symmetrical about a center line 97 equidistant between inner side 91 and outer side 95.

A secondary piston 52 is also provided to assure unlocking in the event primary piston 42 fails. Secondary piston 52 is an annular member carried in annular hydraulic chamber 40 below primary piston 42. Secondary piston 52 has an inner diameter with a bidirectional seal 55 that slidingly engages hydraulic chamber inner wall 40*a*. Secondary piston 52 has an outer diameter with a bidirectional seal 57 that slidingly engages hydraulic chamber outer wall 40*b*. Referring to FIG. 3, secondary piston 52 includes an bidirectional upper seal 62 that slidingly engages hydraulic chamber outer wall 40*b*. Upper seal 62 allows secondary piston 52 to travel past hydraulic port 64 without leakage of hydraulic pressure from hydraulic chamber 40 on the lower side of secondary piston 52 into hydraulic chamber 40 between the top side of secondary piston 52 and the bottom side of primary piston 42. Secondary piston 52 is not physically connected to primary piston 42 nor to connecting rods 44. When at its lower position, secondary piston 52 rests on top of the upper horizontal surface of cap ring 51.

Referring to FIG. 3, secondary piston 52 has an upper side with an annular recess 101 having a mating configuration to annular band 83 to receive and mate with annular band 83 while primary piston 42 and secondary piston 52 are in abutment with each other. Secondary piston 2 has a lower side with an annular band 103. Annular band 103 has a flat bottom surface 105 that is perpendicular to a longitudinal axis of housing 30 (FIG. 1). Side walls 107 join annular band 103 with the inner and outer border surfaces 109 on the lower side of secondary piston 52. Side walls 107 converge toward each other in a downward direction. Inner and outer border surfaces 109 are flat and located in a single plane parallel to and elevated above bottom surface 105. Annular band 103, side walls 107 and border surfaces 109 are symmetrical about center line 97 when viewed in a transverse sectional plane.

Cap ring 51 is bolted to the bottom face of connector housing 30 and is the bottom closure of hydraulic chamber 40. Referring to FIG. 3, cap ring 51 has an inner diameter with a bidirectional seal 66 that statically engages hydraulic chamber inner wall 40*a*. Cap ring 51 has an outer diameter with a bidirectional seal 68 that statically engages hydraulic chamber outer wall 40*b*.

Cap ring 51 has an upper side having an annular recess 111 with a mating configuration for secondary piston annular band 103 for receiving annular band 103 while secondary piston 52 is in abutment with cap ring 51.

Two upper ports 48 extend through housing 30 to hydraulic chamber 40 above primary piston 42. Upper ports 48 provide hydraulic fluid pressure to the upper side of primary piston 42 to force it downward. Two lower ports 64 extend through housing 30 to hydraulic chamber 40 below primary piston 42 and above secondary piston 52 when secondary piston 52 is in its lower position, shown on both sides of FIG. 1. Lower ports 64 provide hydraulic fluid pressure to the lower side of primary piston 42 to force primary piston 42 upward to unlock connector 28.

Two secondary lower ports 50 extend through housing 30 to hydraulic chamber 40 below secondary piston 52. Secondary lower ports 50 provide hydraulic fluid pressure to the lower side of secondary piston 52 to force secondary piston 52 and primary piston 42 upward to unlock connector 28 in the event of unsuccessful connector 28 unlock using lower ports 64 to unlock connector 28.

Referring to FIG. 3, four upper hydraulic conduits or grooves 70 machined radially in the horizontal direction in recess 101, on top surface of secondary piston 52 allow hydraulic pressure from lower hydraulic ports 64 to communicate to inner half of piston chamber 40 below primary piston 42 and above secondary piston 52 when primary piston 42 is in a lower position contacting secondary piston 52.

Four lower hydraulic conduits or grooves 72 machined radially in the horizontal direction in recess 111 on top surface of cap ring 51 allow hydraulic pressure from secondary lower hydraulic ports 50 to communicate to inner half of piston chamber 40 below secondary piston 52 and above cap ring 51 when secondary piston 52 is in its lower position contacting cap ring 51.

In operation, the wellhead connector 28 will be lowered over the wellhead 20 until reaching the position shown in FIG. 1. Initially, dogs 24 will be in the retracted position, shown on the left side of FIG. 1. The cam ring 38 and primary piston 42 will be in an upper position because of the position of dogs 24. Secondary piston 52 would be staged in the lower position shown. Hydraulic fluid is then supplied to an upper port 48, which forces primary piston 42 to move downward bringing with it cam ring 38. This will initially start the dogs 24 moving inward by the engagement with the beveled edge 43 of cam ring 38. The cam ring 38 and connecting rods 44 will continue downward with the primary piston 42 until the inner side 39 of cam ring 38 engages the outer toroidal surface 34 of dogs 24 until dogs 24 have fully engaged wellhead housing 20 and a selected hydraulic pressure is reached. At that point, cam ring 38 will be spaced slightly above the top surface 54 of bulkhead 41 of tubular housing 30 as shown in the right side of FIG. 1. When dogs 24 are in the fully locked position, a control mechanism (not shown) will release the hydraulic fluid flow through the upper port 48. Primary piston 42 will be closely spaced to from the top of secondary piston 52.

Figure 4:
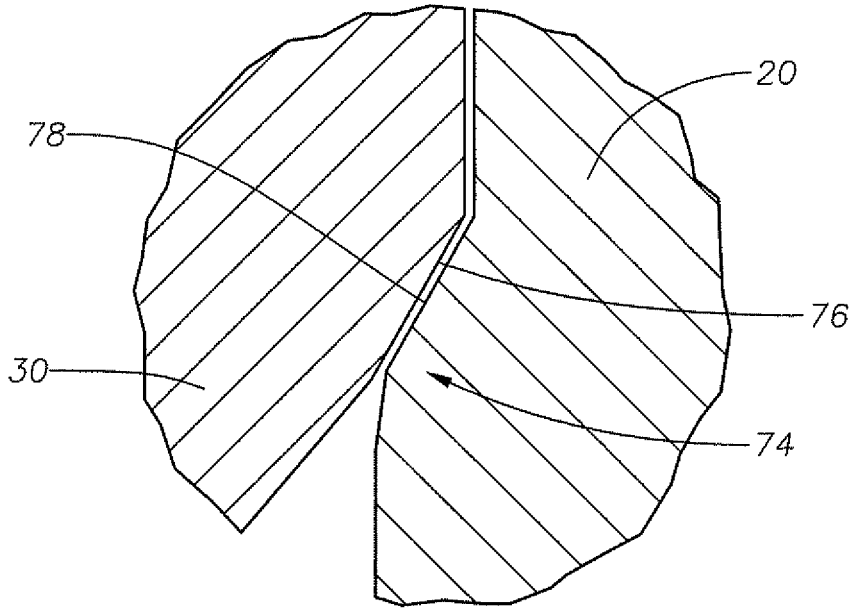
FIG. 4 is an enlarged view of the interface between a raised profile on the lower outer diameter of the wellhead housing and the tapered shoulder of the lower inside diameter of the connector housing.

A raised profile 74 is formed on the lower outer diameter of wellhead 20 proximate the lower inner profile of housing 30. Referring to FIG. 4, raised profile 74 is engaged by a tapered shoulder 76 of the lower inside diameter of housing 30. Raised profile 74 is spaced below wellhead profile 22 at as great a distance as possible without increasing the overall length of the wellhead connector. Raised profile 74 is also provided with a tapered shoulder 78.

In operation, before preload and after landing the wellhead connector 28 on the wellhead 20, a slight clearance exists between tapered shoulder 76 and tapered shoulder 78. At preload, housing 30 deflects downward, engaging shoulders 78 and 76 creating a secondary load path for the applied bending moment. The secondary load path increases the bending capacity of the connector and wellhead.

When it is desired to release the wellhead connector, hydraulic fluid pressure is supplied to a lower port 64. This causes the primary piston 42 to push upward. As the primary piston 42 moves upward, cam ring 38 moves upward out of engagement with dogs 24. Because of the angle of the downward facing shoulders of grooves 26, an upward pull on housing 30 after cam ring 38 has released dogs 24 causes dogs 24 to slide out of engagement with grooves 22. If primary piston 42 leaks, the hydraulic fluid pressure can be directed through a secondary lower port 50 causing secondary piston 52 to move upward engaging primary piston 42 to unlock the wellhead connector.

The invention has significant advantages. The reduced cross-section cam ring and single annular piston results in a smaller, lighter, more efficient, and less expensive wellhead connector than the prior art types. The use of a separate primary and secondary pistons enables the connector to be released even if the primary piston leaks.

While this invention has been shown in only one of its forms, it should be apparent to those skilled in the art that it is not so limited but is susceptible to various changes without departing from the spirit and scope of the invention.

We claim:

1. A wellhead connector for connecting an upper tubular member to a lower tubular member, the connector comprising:

a housing adapted to be secured to the upper tubular member for sliding over the lower tubular member, the housing having an axis, an annular cam cavity, and an annular hydraulic chamber axially separated from the cam cavity by a stationary annular bulkhead;

a plurality of dogs carried in the cam cavity, with the dogs being located within an aperture of the housing for movement from an unlocked position inward to a locked position for engagement with a profile on the exterior of the lower tubular member;

a cam ring carried in the cam cavity for axial movement, the cam ring having an inner side which engages an outer side of each of the dogs for moving the dogs inward into the locked position;

an annular primary piston carried in the hydraulic chamber for axial movement;

an annular band extending downward from a lower side of the primary piston concentric with the axis of the housing, the band having inner and outer side walls joining the lower side of the primary piston with a bottom surface of the band, the band being symmetrical about a center line between inner and outer sides of the primary piston when viewed in a transverse cross-section:

a plurality of rods connected between the primary piston and the cam ring for moving the cam ring in unison with the primary piston, each of the rods extending sealingly through a hole formed in the annular bulkhead;

an annular secondary piston carried in the hydraulic chamber for axial movement independently from the primary piston and located below the primary piston; and an annular recess on an upper side of the secondary piston, the recess having a mating configuration for the band to receive and mate with the band while the primary and secondary pistons are in abutment with each other.

2. The wellhead connector of claim 1, further comprising at least one groove located in the recess on the upper side of the secondary piston, defining a flow path between the lower side of the primary piston and the upper side of the primary piston while the primary and secondary pistons are in abutment with each other; and a hydraulic fluid passage extending through a side wall of the housing into the cavity at a point in fluid communication with the flow path for selectively applying hydraulic fluid pressure to move-the primary piston upward relative to the secondary piston.

3. The wellhead connector of claim 2, wherein the groove extends radially relative to the axis of the housing.

4. The wellhead connector of claim 1, wherein the bottom surface of the band is flat.

5. The wellhead connector of claim 1, wherein the side walls of the band converge toward each other in a downward direction.

6. The wellhead connector of claim 1 wherein the lower side of the primary piston further comprises:

a flat inner border surface joining the inner side wall of the band with the inner side of the primary piston: and a flat outer border surface joining the outer side wall of the band with the outer side of the primary piston.

7. The wellhead connector of claim 1, wherein each connecting rod is cylindrical and has a smaller diameter than a transverse width of the cam ring and the primary piston.

8. The wellhead connector of claim 7, wherein the connecting rods further comprise threaded ends connected to the cam ring and the primary piston.

9. The wellhead connector of claim 1, further comprising:

a downward facing tapered shoulder located on the housing; and an upward facing tapered shoulder located on the lower tubular member for engagement with the downward facing shoulder on the housing.

10. The wellhead connector of claim 1, further comprising:

an annular secondary piston band on a lower side of the secondary piston the secondary piston band having inner and outer side walls joining the lower side of the secondary piston with a bottom surface of the secondary piston band, the secondary piston hand being symmetrical about a center line between inner and outer sides of the secondary piston when viewed in a transverse cross-section; and wherein the hydraulic chamber has a lower end defined by a removable cap ring and wherein an upper surface of the cap ring has an annular cap ring recess that is concentric with the axis of the housing and has the same configuration as the secondary piston band for mating in the secondary piston band while the secondary piston is in the lower position.

11. A subsea wellhead assembly comprising:

an upper tubular member;

a lower tubular member;

a housing secured to the upper tubular member and positioned over the lower tubular member, the housing having an axis, an annular cam cavity, and an annular hydraulic chamber located below the annular cam cavity, the cam cavity and hydraulic chamber being axially separated from each other by an annular bulkhead, and the hydraulic chamber having cylindrical, concentric inner and outer walls extending around the axis of the housing;

a plurality of dogs carried in the cam cavity, with the dogs being located within an aperture of the housing for movement from an unlocked position inward to a locked position for engagement with a profile on the exterior of the lower tubular member;

a cam ring carried in the cam cavity for axial movement, the cam ring having an inner side which engages an outer side of each of the dogs for moving the dogs inward into the locked position;

an annular primary piston carried in the hydraulic chamber for axial movement, the primary piston having seals on its inner and outer sides for engaging the inner and outer walls of the hydraulic chamber;

a plurality of rods connected between the primary piston and the cam ring for moving the cam ring in unison with the primary piston, each of the rods extending sealingly through a hole formed in the annular bulkhead;

an annular primary piston band extending downward from a lower side of the primary piston concentric with the axis of the housing, the primary piston hand having inner and outer side walls joining the lower side of the primary piston with a bottom surface of the primary piston band the primary piston band being symmetrical about a center line between inner and outer sides of the primary piston;

an annular secondary piston carried in the hydraulic chamber for axial movement independent of the primary piston the secondary piston being below the primary piston: and an annular recess on an upper side of the secondary piston, the recess having a same configuration as the primary piston band to receive and mate with the primary piston hand while the primary and secondary pistons are in abutment with each other;

an annular secondary piston band extending downward from a lower side of the secondary piston concentric with the axis of the housing the secondary piston band having inner and outer side walls joining the lower side of the secondary piston with a bottom surface of the secondary piston band the secondary piston band being symmetrical about a center line between inner and outer sides of the secondary piston;

a removable cap ring defining a lower end of the hydraulic chamber, and an annular cap ring recess on an upper side of the cap ring that has a mating configuration for the secondary piston band for receiving the secondary piston band while the secondary piston is in abutment with the cap ring.

12. The subsea wellhead assembly of claim 11, further comprising radially extending grooves in each of the recesses.

13. The subsea wellhead assembly of claim 11, wherein the bottom surface of each of the bands is flat.

14. The subsea wellhead assembly of claim 11, wherein:

the side walls of the primary piston band incline toward each other in a downward direction; and the side walls of the secondary piston band incline toward each other in a downward direction.

15. The subsea wellhead assembly of claim 11, further comprising:

a plurality of fasteners contained within cam ring; and a plurality of threaded holes located in the primary piston;

wherein the connecting rods have a first end connected to the fasteners and a second end connected to the threaded holes; and wherein the fasteners and the first end of the connecting rod have spherical bearing surfaces with low friction coatings.

16. The subsea wellhead assembly of claim 11, wherein the lower side of the primary piston further comprises:

a flat inner border surface joining the inner side wall of the primary piston band with the inner side of the primary piston; and a flat outer border surface joining the outer side wall of the primary piston band with the outer side of the primary piston.

17. The subsea wellhead assembly of claim 16, further comprising:

wherein the lower side of the secondary piston further comprises:

a flat inner border surface joining the inner side wall of the secondary piston band with the inner side of the secondary piston; and a flat outer border surface joining the outer side wall of the secondary piston band with the outer side of the secondary piston.

* * * * *